US005292254A

United States Patent [19]

Miller et al.

[11] Patent Number: 5,292,254

[45] Date of Patent: Mar. 8, 1994

[54] METHOD FOR DETERMINING MINEFIELD EFFECTS IN A SIMULATED BATTLEFIELD

[75] Inventors: Joseph R. Miller, Tempe; Craig T. Griffin, Chandler, both of Ariz.

[73] Assignee: Motorola, Inc., Schaumburg, Ill.

[21] Appl. No.: 76

[22] Filed: Jan. 4, 1993

[51] Int. Cl.[5] ..... F41A 33/00

[52] U.S. Cl. ..... 434/11; 434/12; 434/23; 102/427; 364/423; 364/578; 340/326; 273/439

[58] Field of Search ..... 434/11-27; 102/401-407, 410, 411, 335; 89/41.01; 340/384 R, 326, 385, 410, 411, 435; 446/400, 401, 405, 473; 364/423, 578; 273/311, 313, 439, 460

[56] References Cited

U.S. PATENT DOCUMENTS

| | | | |
|---|---|---|---|
| 4,232,313 | 11/1980 | Fleishman | 364/453 X |
| 4,682,953 | 7/1987 | Doerfel et al. . | |
| 4,695,058 | 9/1987 | Carter, III et al. | 434/16 X |
| 4,744,761 | 5/1988 | Doerfel et al. . | |
| 4,752,226 | 6/1988 | Akers et al. | 434/11 |
| 4,976,619 | 12/1990 | Carlson . | |
| 5,027,709 | 7/1991 | Slagle | 102/427 |
| 5,074,793 | 12/1991 | Hambric et al. | 434/11 |
| 5,207,579 | 5/1993 | Campagmolo | 340/326 X |
| 5,228,854 | 7/1993 | Eldridge | 364/423 X |

*Primary Examiner*—Richard J. Apley
*Assistant Examiner*—Joe E. Cheng
*Attorney, Agent, or Firm*—Frank J. Bogacz

[57] ABSTRACT

A method for a minefield simulation includes a number of troops and vehicles each including a player detection device or vehicle detection device respectively. The player detection devices and vehicle detection devices determine and transmit their respective locations to a central computer. The central computer or player determines whether the player is within an activation radius of a mine in the minefield. The central computer or player has established a bit map of the minefield with indications of the exact placement of the mines within the minefield. If a player (troop or vehicle) is within the activation radius of a mine, the central computer or player records the identity of the expended mine in the minefield bit map by changing its indication from active to inactive. Either central computer or the player detection device may determine the effects of the expended mine upon the troop or vehicle.

24 Claims, 6 Drawing Sheets

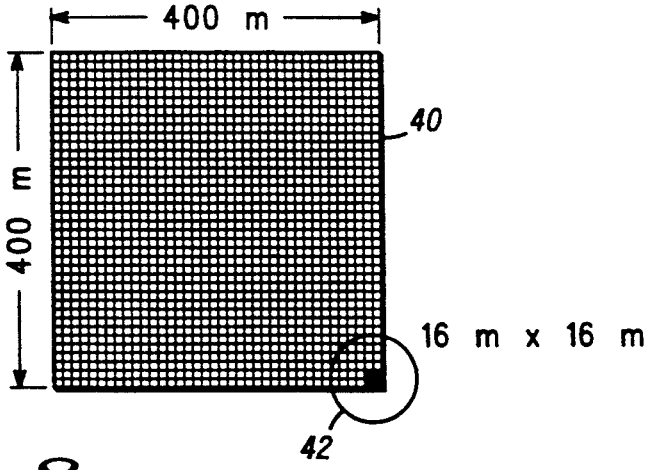
FIG. 8
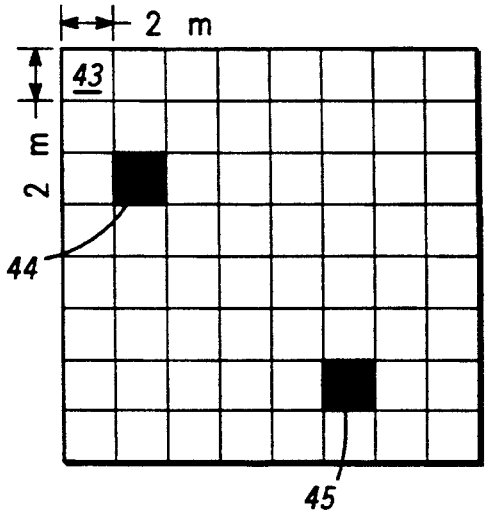
FIG. 2
FIG. 3
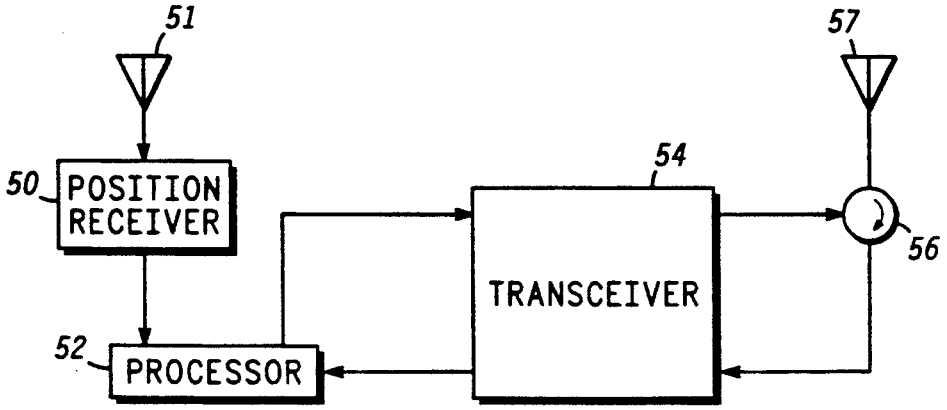

METHOD FOR DETERMINING MINEFIELD EFFECTS IN A SIMULATED BATTLEFIELD

BACKGROUND OF THE INVENTION

The present invention pertains to battlefield simulation systems and more particularly to systems where accurately simulating the effects of mine warfare.

Present simulation systems provide for opposing forces to engage one another in force-on-force training in simulated battles. These simulated battles are called exercises. During these exercises, combined arms forces engage in battle using laser transmitters and receivers/decoders for simulating the effect of direct fire weapons like tank guns and small arms fire. Manual, RF or GPS based systems are used to simulate the effects of indirect fire (artillary, mortar, mine, nuclear, chemical and biological).

One of the remaining shortfalls of the combined arms training exercise simulation systems is the inability of such systems to accurately simulate the effects of mine warfare. In such systems which support minefield warfare, devices worn by vehicles and troops detect their position and self-determine whether their position is close enough to a mine to detonate the mine. A more common method is to assign a uniform probability over the entire minefield and base the effects on time in the minefield. However, subsequent troops which come across the same location where a mine has previously been detonated also detonate the mine. Therefore, there is no reward for taking evasive or defensive maneuvers once a mine is detected. The location determining devices carried by troops and vehicles is a receive only link. Since the receive only device is carried by vehicles and troops self-determine their position and compare it to a predetermined minefield arrangement, subsequent troops entering the same area do not have the benefit of previous detonation of a mine in that area. That is, a first troop or vehicle will set off a particular mine at a particular location and the second vehicle or troop passing that same location will also set off the same mine. This does not monitor actual warfare. Once a mine is detonated, subsequent troops or vehicles may travel that location without being destroyed by the mine.

It would be highly desirable to provide a method for determining minefield effects providing for only a single detonation of a mine in the simulated battlefield.

SUMMARY OF THE INVENTION

In accordance with the present invention, a novel method for determining minefield effects in a simulated battlefield is shown.

A methodology for minefield simulation first determines the position of the player to which the device is affixed. Next, the central computer or player determines whether the player is within a particular activation radius of a mine in the minefield. If the player is within the activation radius of the mine, the mine is detonated and the identity of the expended mine is recorded in a minefield bit map. Lastly, the player detection device or the central computer determines the effects of the expended mine upon the player.

BRIEF DESCRIPTION OF THE DRAWINGS

FIG. 2 is a bit map depicting the battlefield as shown in FIG. 1 in accordance with the present invention.

FIG. 3 is a block diagram of a player detection device/vehicle detection device in accordance with the present invention.

FIG. 8 as a bit map depicting the battlefield as shown in FIG. 1 in accordance with the present invention.

DESCRIPTION OF THE PREFERRED EMBODIMENT

Figure 1:
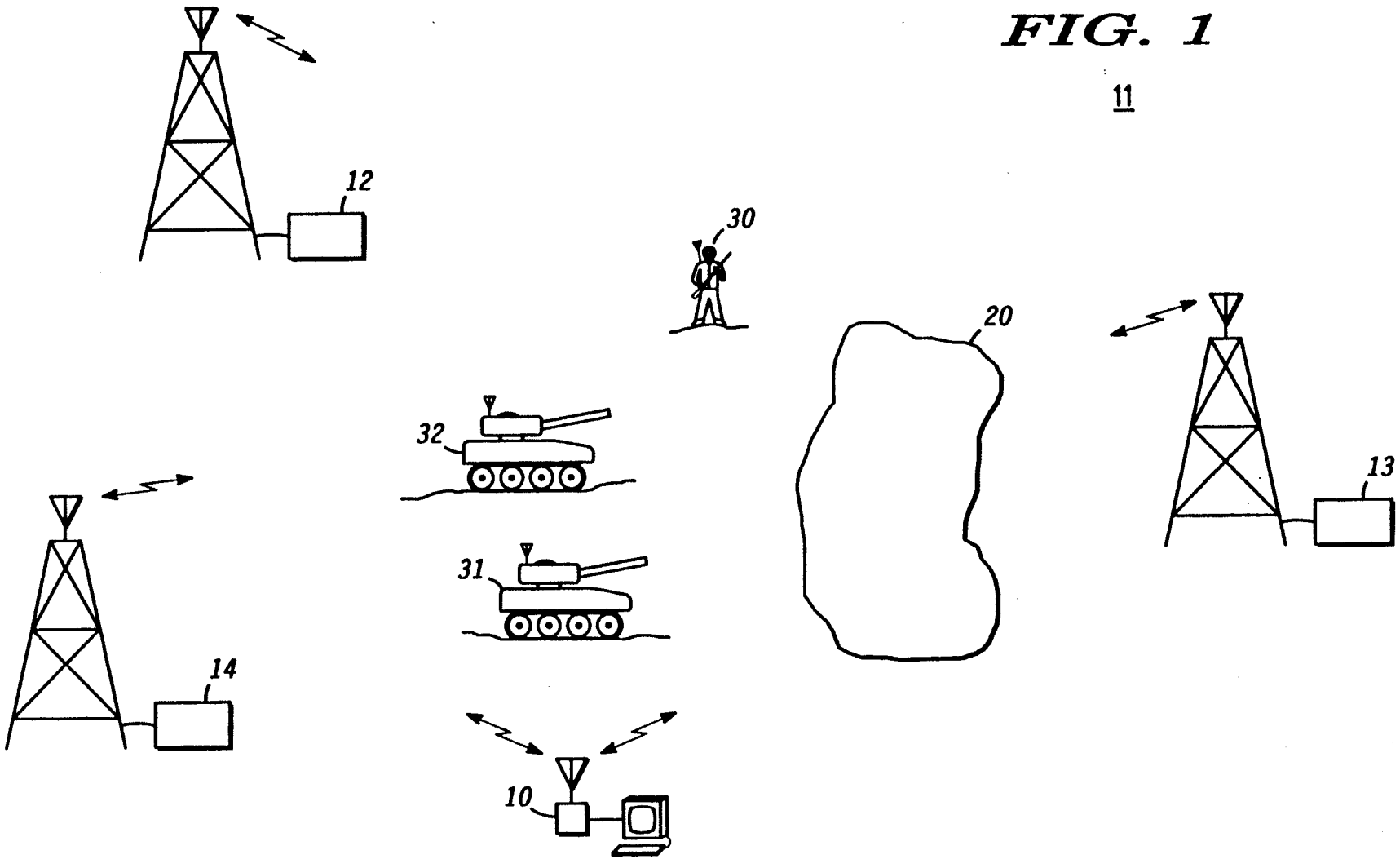
FIG. 1 is a sketch of a simulated battlefield including minefield in accordance with the present invention.

FIG. 1 is a sketch of a war game battlefield 11. The battlefield 11 depicts mission control station 10, relays 12–14, minefield 20, and players 30–32.

Under the control of an operator (not shown), mission control station 10 transmits a message to the players notifying them of the minefield location, type, size, density and shape. Player detection devices and vehicle detection devices are discussed in U.S. Pat. No. 4,976,619 which is hereby incorporated by reference.

Each player 30–32 includes a processor, a position receiver, and a transceiver. Each detection device associated with a troop 30 or vehicle detection device associated with a vehicle 31 or 32 determines its own position using multilateration techniques or third-party systems such as GPS, Loran, or alternatively, it can be determined at the central computer, using transponder-type methods.

As troops 30 and vehicles 31–32 encroach upon minefield 20, they may take various paths through the minefield. Mines may be placed within the minefield in a random or ordered pattern that is the same for every player encountering the minefield. As the players 30 and vehicles 31–32 encroach upon minefield 20, their position is known as mentioned above. Since this is a battlefield simulation, no real mines are used. Mines are placed electronically throughout minefield 20 in a minefield bit map kept by central computer 10 or players 30–32. Therefore the position of each player 30–32 and the position of each of the mines are required in order to determine whether a player is damaged or injured as it traverses minefield 20. Each of the relays 12–14 could transmit data received from the mission control station 10 to each of the PDDs and VDDs for the PDDs and VDDs to determine where the mines are in the field and their proximity to that position. Transmitting the massive amounts of information to represent the individual mines in the minefield would be impractical since terrain and weather would provide a high probability of receiving incomplete messages and errors. As a result, to effectively assess minefield effects with inaccurate data would provide a highly unreliable assessment. Therefore, a more effective method of mine emplacement in a minefield is required.

In order to accomplish the minefield simulation in an updatable, accurate fashion, a minefield bit map representation of the minefield is shown in FIG. 2 and 8. FIG. 8 is a representative minefield bit map. As an example, a 400 meter by 400 meter minefield 40 is shown. At the highest resolution, each cell or square 43 in the grid is approximately 2 meters on a side. Typically about one of every 30 cells would contain a single mine. Lower or higher density minefields may be simulated using the grid structure 40 and activating less or more of the mines in the cells shown. A portion 42 of large minefield grid 40 of FIG. 8 is shown in an exploded view in FIG. 2. This area 42 is a 16 meter by 16 meter grid broken into 2 meter by 2 meter subgrids such as 43, 44, and 45, etc. White colored subgrids such as 43 indicate the absence of a mine in the area. Darkened subgrids such as 44 and 45 indicate a presence of a mine.

For each training exercise, each minefield layout would be initialized to store the complete grid map 40 including each of the subgrids, such as 43–45. Multiple grid maps such as 40 may be stored during a training exercise for simulation of alternate minefield emplacements. These grid or bit maps 40 are typically loaded once either by direct wire line connection to a mission control station, such as 10, or via RF transmission from mission control station through the relays 12–14 to the particular PDD or VDD. New maps may be loaded during the training exercise by the transfer of approximately 40,000 bits necessary to identity each subgrid in the bit map 40.

As each troop 30 or vehicle 31–32 enters the minefield boundaries, their position is compared by the PDD or VDD respectively according to the bit map mine locations of grid 40.

Individual mines in the grid map 40 will be activated based upon density and type. For example, a minefield density and number and quantity of mines shown for FASCAM (family of scatterable mines) is shown in Table 1. It is to be noted that each grade of density of mines is twice the previous grade. That it, the medium density is twice that of the low density and the high density is twice that of the medium density. Therefore, for a medium density minefield, every other mine in the map of a high density minefield would be activated.

TABLE I

| Method of Fire | Quantities | Mines | Time to Emplace (Planned) | Time to Emplace (Unplanned) |
|---|---|---|---|---|
| Low Density | 24 RAAMs<br>6 ADAMs | 216 RAAM<br>216 ADAM | 7 min | 25 min |
| Medium Density | 48 RAAMs<br>6 ADAMs | 432 RAAM<br>216 ADAM | 10 min | 25 min |
| High Density | 96 RAAMs<br>12 ADAMs | 864 RAAM<br>432 ADAM | 12 min | 25 min |

When a player or vehicle is within a particular radius of a subgrid such as 44, the mine is detonated and the particular explosive are deployed as shown in Table I. In a decentralized implementation, the PDD or VDD reports that a mine at a particular grid location has been expended. This report is made via the PDD or VDD through the relays 12–14 to the mission control station 10. Mission control station 10 updates its minefield bit map 40 to reflect the deployment of the particular mine and transmits a message through relays 12–14 to each of the troops 30 and vehicles 31–32 to update their bit maps 40 in a corresponding fashion. In a centralized implementation, the mission control computer would perform these computations.

As an example, minefield 40 which is a 400 meter by 400 meter field may have mines emplaced in low, medium, or high densities as shown in Table I. Table I defines the mix of mines for low, medium, and high density deployments. In the case of a high density deployment, the total number of mines emplaced is 1296 of which two-thirds are RAAM (remote anti-armor mines) and one-third is ADAM (area denial artillery munition). As a result, for the high density emplacement, mission control station 10 would generate a bit map including 1296 mines spread over the 400 meter by 400 meter minefield 40 in either random, standard, or periodic distribution of mines. Every third mine in minefield 40 will be defined as an ADAM. Similarly, for the low density emplacement condition, 432 mines are emplaced with equal quantities of RAAMs and ADAMs type mines. For the low density case, the identical bit map to the high density bit map is used; however, only every third mine in the map is activated. Of the activated mines for the low density deployment situation, every other mine will be defined as an ADAM. As previously mentioned, mines that are detonated are removed from the active list and the mission control station updates each PDD and VDD through relays 12–14. Detonated mine information may be communicated by X,Y coordinates or a sequential mine number in the field, for example.

In the simulation of a FASCAM method of fire, the minefield may be activated over time to simulate the emplacements times as shown in Table I. The emplacement will be a phase-in emplacement, activating sections of the field at a rate equivalent to the artillery firing rate or conventional mine emplacement time. The timing computation would determine the status of the minefield bit map at any time and will use the minefield density and mission scenario (planned or unplanned) to derive the emplacement times.

Referring to FIG. 3 a block diagram of a player detection device (PDD) or a vehicle detection device (VDD) is shown. Antenna 51 couples information received from timing transmitters such as a multilateration transmitter system, GPS system, or Loran system, to position receiver 50. Processor 52 is coupled to transceiver 54. Receive and transmit leads couple transceiver through circulator 56 to antenna 57.

Position receiver 50 converts the RF time information into digital form and transmits it to processor 52. Processor 52 determines the actual location of the PDD or VDD attached to the troop or vehicle, respectively. Processor 50 compares the location of the troop or vehicle to the bit map prestored in it. If the position indicates that a mine is detonated, processor 52 via transceiver 54 and circulator 56 transmits a message via antenna 57 through one of the relays 12–14 to the mission control station indicating that the troop or vehicle has been damaged or destroyed in a decentralized implementation, for example. In addition, updates to previously detonated mines are transmitted to all troops and vehicles PDDs and VDDs respectively from mission control station 10 through one of the relays 12–14 to antenna 57, through circulator 56 and transceiver 54 to processor 52. Processor 52 receives this message and updates its minefield bit map so that two or more consecutive troops in the same area will not activate previously activated mines in the same location. As a result, once a mine is expended, it will not be seen again by subsequent troops or vehicles. Further, subsequent troops and vehicles will not report to the mission control station that they have been destroyed erroneously by the same mine.

Figure 4:
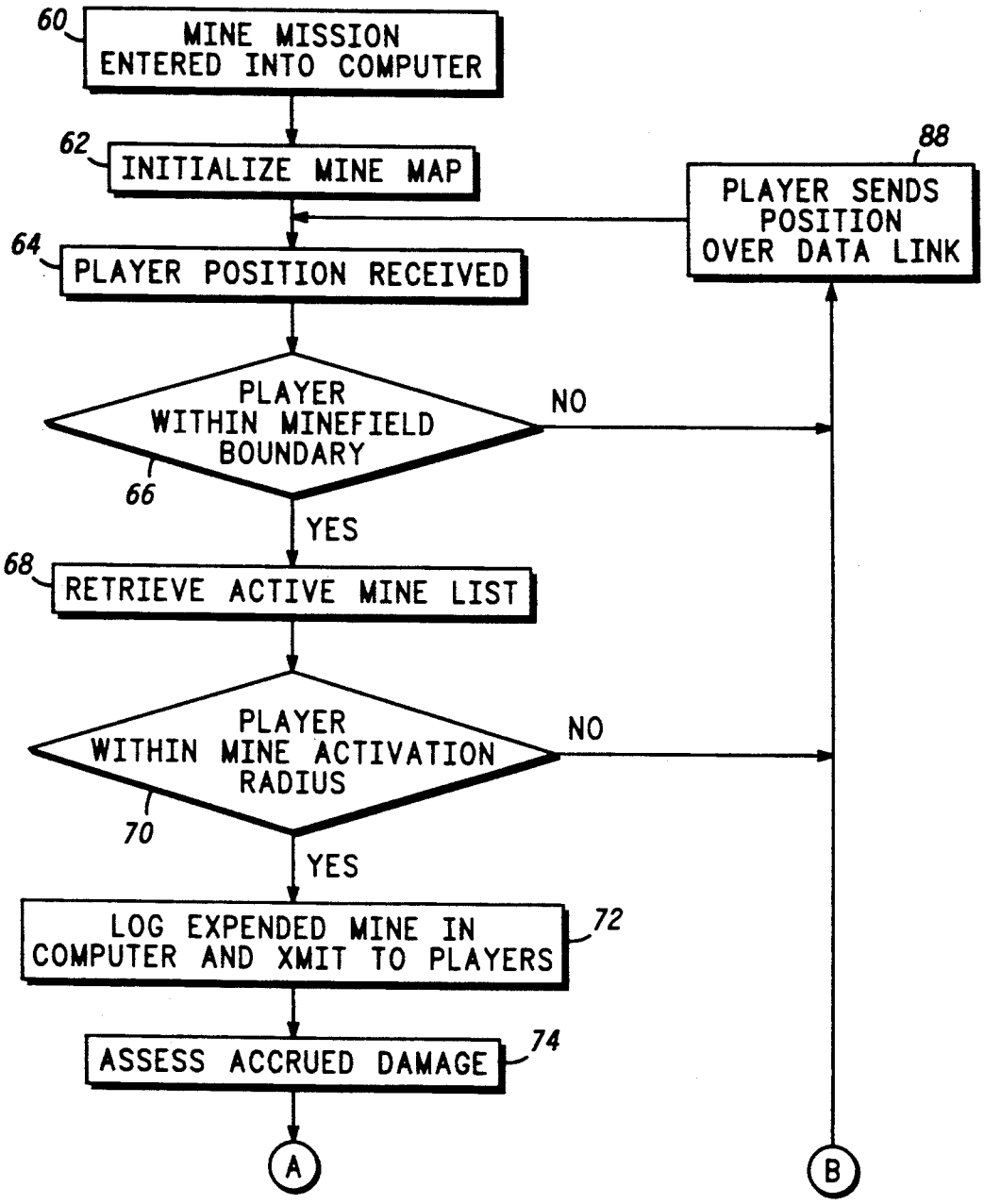
FIG. 4 and FIG. 5 are flow charts of a method in accordance with the present invention for centralized control of a minefield.
Figure 5:
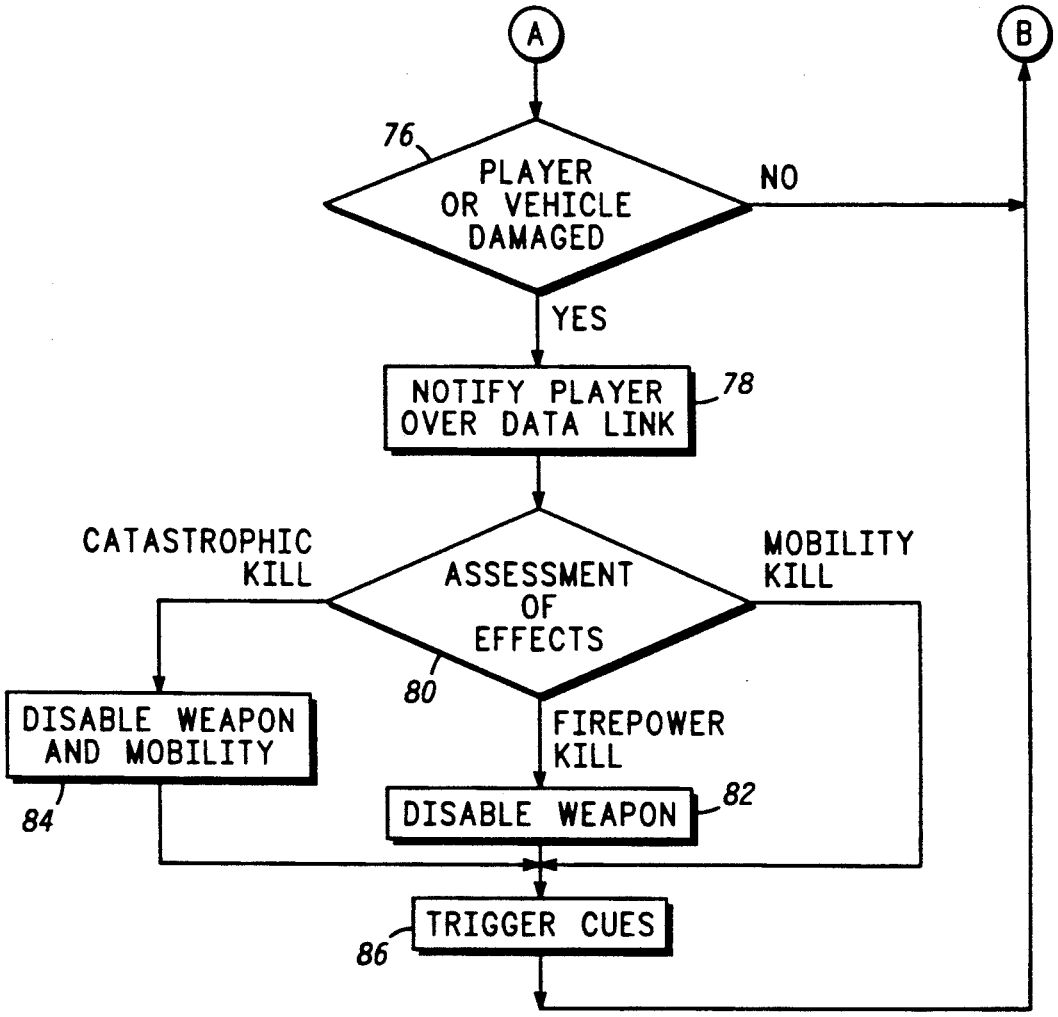

FIG. 4 and FIG. 5 depict a centralized method for minefield assessment in a simulated battlefield in which the central computer determines when mines are detonated, maintains the minefield bit map and assesses casualties. Block 60 enters the mine mission into the central computer. The appropriate density and placement of mines is selected and entered into the bit map of FIG. 2, block 62. Each PDD or VDD transmits its position via the relays to the mission control station, block 64. Next, the method of the mission control station determines whether the player or vehicle is within the minefield boundary, block 66. If the player or vehicle is not within the boundary, control is transferred to block 88 which repeatedly receives player or vehicle information for each troop or vehicle and returns to block 64 for subsequent processing. If the player or vehicle is within the minefield boundary, block 66 transfers control via the YES path to block 68.

Block 68 retrieves the active mine list and transfers control to block 70. Block 70 determines whether the player or vehicle is within the activation radius of the location of the mine. If the player or vehicle is not within the activation radius, control is transferred from block 70 via the NO path to block 88 which sends the player or vehicle position information. If the player is within the activation radius, control is transferred to block 72 via the YES path. The expended mine is logged into the mission control computer's 10 data base and the identity of the expended mine is updated in the minefield bit map, block 72.

Next, the damages are assessed, block 74. Block 76 determines whether the player or vehicle is damaged. If the player or vehicle is not damaged, control is transferred from block 76 via the NO path to block 88. If the player or vehicle is damaged, control is transferred to block 78 via the YES path. Block 78 notifies the player or vehicle of the damage or kill via a message through the relays to the corresponding PDD or VDD.

In the centralized mode, the remaining steps, including process box 88, are all performed by the PDD or VDD as the case may be. Block 80 assesses the effects of the damage. For a mobility kill, the player or vehicle may not move but may still fire its weapon and control is transferred to block 86 which triggers audio/visual queues, such as mock explosions and smoke. If the assessment is a fire power kill, block 80 transfers control to block 82 which disables the player's or vehicle's weapon and triggers the audio/visusl queues, block 86. For a catastrophic kill, block 80 transfers control to block 84 which disables the player's or vehicle's weapons and its mobility. As a result, the player or vehicle has been completely killed. Block 86 transfers control to block 88 which tracks each PDD or VDD and receives their position.

Figure 6:
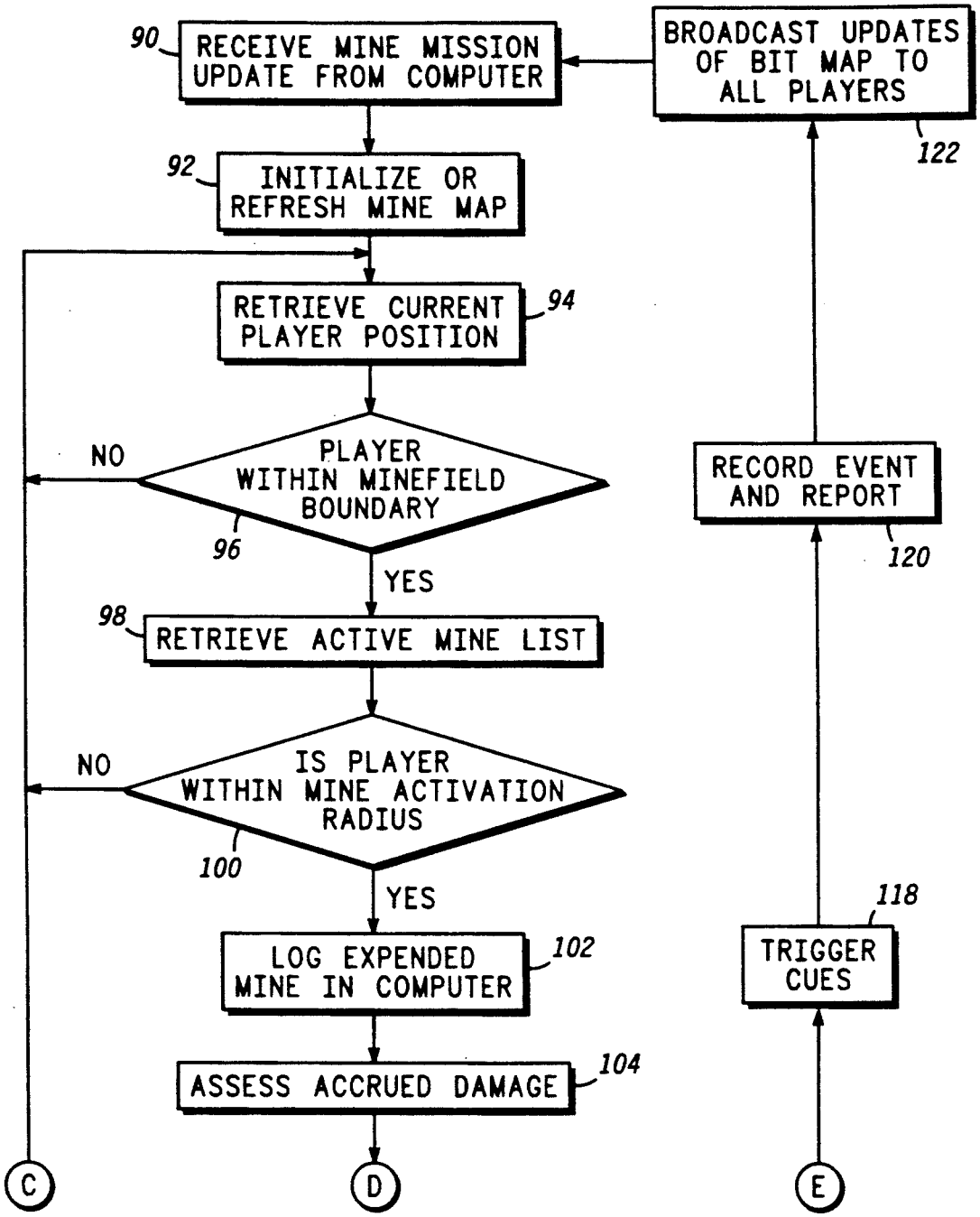
FIG. 6 and FIG. 7 are flow charts of a method in accordance with the present invention for decentralized control of a minefield.
Figure 7:
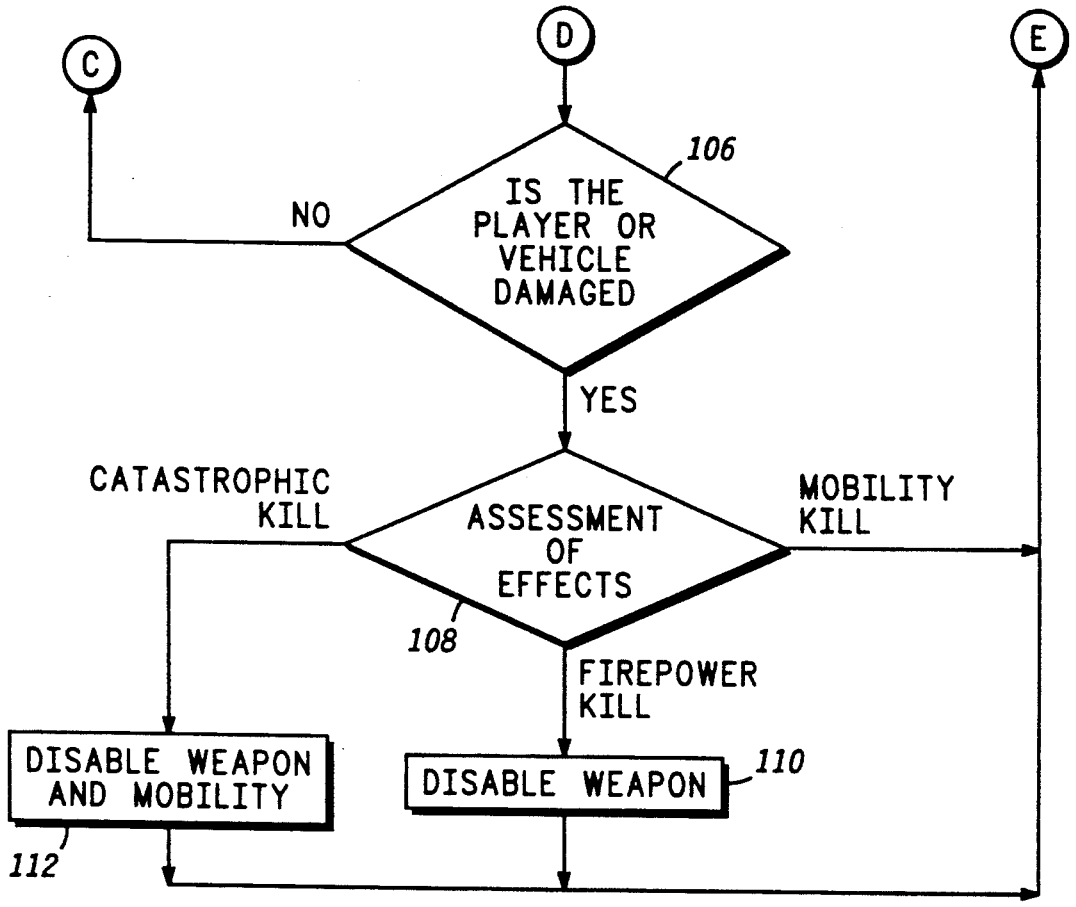

FIG. 6 and FIG. 7 depict the decentralized method for minefield simulation according to the present invention in which the PDD or VDD stores and updates the minefield bit map and performs casualty assessment. Each of the steps performed in FIGS. 6 and 7 are performed by the processor of the player detection device (PDD) or vehicle detection device (VDD). Block 90 inputs the mine mission information and updates into the processor 52 of the PDD or VDD. Next, the bit map shown in FIG. 2 is initialized and refreshed or updated upon detonation of mines, as appropriate, block 92 based upon updates received from the central computer 10 through the relays 12-14. Each of the PDDs and VDDs have reported their current position to the mission control computer 10 or the position may be determined by the mission control computer 10. Next, the PDD or VDD retrieves or determines its current position, block 94. The PDD or VDD then determines whether it is within the boundary of the minefield 20, block 96. If the player or vehicle is not within the minefield boundary, block 96 transfers control to block 94 via the NO path. If the player or vehicle is within the minefield boundary, block 96 transfers control to block 98 via the YES path.

Block 98 retrieves the active mine list which is a minefield bit map as shown in FIG. 2. Next, block 100 determines whether the player is within the mine activation radius. If the player is not within the mine activation radius, block 100 transfers control to block 94 via the NO path. If the player is within the mine activation radius, the mine has been activated and block 100 transfers control block 102 via the YES path. Block 102 logs the expended mine into the PDD's or VDD's data base. That is, the PDD or VDD processor updates its minefield bit map to reflect that a particular mine has been exploded.

Next, the PDD or VDD assesses the damages incurred by the player or vehicle, block 104. That is, the PDD or VDD takes into account the kind of munition exploded, its range, and the proximity of the player to the mine. Block 106 determines whether the player or vehicle is damaged. If the player or vehicle is not damaged, block 106 transfers control to block 94 via the NO path. If the player or vehicle has been damaged, block 106 transfers control to block 108.

Block 108 assesses the effects of the explosion of the mine. If the effect was a mobility kill, the player or vehicle may not move but may still fire its weapon and block 108 transfers control to block 118 via the mobility kill path. Block 118 sends a message to the particular player or vehicle to trigger audio/visual queues such as the deployment of mock explosion and/or smoke. Then block 120 records the event and reports the event to the central computer through the relays 12-14. Then block 120 transfers control to block 122, wherein the central computer receives the expended mine update report and broadcasts the updates to all PDDs and VDDs through the relays 12-14. Control is then transferred to block 90 to continuously repeat the process for each player.

If the assessment of the effects is a fire power kill, block 108 transfers control to block 110 via the fire power kill path. Block 110 disables the weapon and transfers control to block 118 and the process continues as described above.

If block 108 determines a catastrophic kill, block 108 transfers control to block 112. Block 112 disables the weapon and the mobility of the troop or vehicle. Block 112 then transfers control to block 118 to trigger any appropriate audio/visual queues associated with the troop or vehicle. Then block 120 records the event and makes the appropriate report and transfers control to block 122 to repeat the method.

As can be seen, the disclosed invention meets the needs and advantages set out above. More particularly, the present invention provides for bit mapping of a simulation minefield. In addition, this simulated minefield whether kept by central computer or within the player detection device/vehicle detection device associated with troops and vehicles respectively, continually updates the bit map to reflect previously detonated mines. Thereby subsequent troops or vehicles entering an area where a mine has previously been exploded will not erroneously be reported as subsequent fatalities. Thereby, the system provided is one which more accurately reflects the effects of a minefield upon troops and vehicles.

Although the preferred embodiment of the invention has been illustrated, and that form described in detail, it will be readily apparent to those skilled in the art that various modifications may be made therein without departing from the spirit of the invention or from the scope of the appended claims.

What is claimed is:

1. A method for minefield simulation comprising the steps of:

determining by a player detection device a position of a player in a simulated battlefield;

determining by a central computer whether the player is with a particular activation radius of a simulated mine in the minefield simulation of the simulated battlefield;

recording by the central computer an identity of an expended mine in a minefield bit map, if the player is within the particular activation radius of the mine; and determining by the player detection device the effects of the expended mine upon the player.

2. A method for minefield simulation as claimed in claim 1, wherein there is further included the step of entering into the player detection device a particular mine dispersion in the minefield.

3. A method for minefield simulation as claimed in claim 2, wherein there is further included the step of initializing the minefield bit map according to an entered mine dispersion.

4. A method for minefield simulation as claimed in claim 1, wherein there is further included the step of determining whether the player is within the minefield boundaries.

5. A method for minefield simulation as claimed in claim 4, wherein there is further included the step of retrieving by the player detection device the minefield bit map, if the player is within the minefield boundary.

6. A method for minefield simulation as claimed in claim 5, wherein said step of recording includes the step of transmitting a message indicating the expended mine to a plurality of player detection devices.

7. A method for minefield simulation as claimed in claim 6, wherein there is further included the steps of:

assessing damages inflicted upon the players including dismounted troops and vehicles; and determining the damage to the dismounted troops and vehicles.

8. A method for minefield simulation as claimed in claim 7, wherein said step of determining by the player detection device the effects of the expended mine includes the steps of:

disabling the weapon and mobility of the player, if a catastrophic kill was determined; and triggering by the player detection device audio and visual queues.

9. A method for minefield simulation as claimed in claim 7, wherein the step of determining by the player detection device the effects of the expended mine includes the steps of:

disabling the player's weapon, if a fire power kill has been determined; and triggering by the player detection device audio and visual queues.

10. A method for minefield simulation as claimed in claim 7, wherein the step of determining by the player detection device the effects of the expended mine includes the steps of:

disabling the mobility of the player, if a mobility kill has been determined; and triggering by the player detection device audio and visual queues.

11. A method for minefield simulation as claimed in claim 1, wherein there is further included the step of repeating the steps of determining by a player detection device a position of a player, determining by the player detection device whether the player is within the activation radius of a mine, recording by the central computer and determining by the player detection device the effects of the expended mine for each of a plurality of players including dismounted troops and vehicles.

12. A method for minefield simulation as claimed in claim 1, wherein said step of recording includes the steps of:

setting by the player detection device to a first logic value locations in the minefield bit map corresponding to active mines;

setting by the player detection device to a second logic value all locations in the minefield bit map, except those locations with active mines; and updating by the player detection device locations in the minefield bit map from the first logic value to the second logic value for expended mines.

13. A method for minefield simulation comprising the steps of:

determining by a central computer a position of a player in a simulated battlefield;

determining by the central computer whether the player is within a particular activation radius of a simulated mine in the minefield simulation of the simulated battlefield;

recording by the central computer an identity of an expended mine in a minefield bit map, if the player is within the particular activation radius of the mine; and determining by the central computer the effects of the expended mine upon the player.

14. A method for minefield simulation as claimed in claim 13, wherein there is further included the step of entering into the central computer a particular mine dispersion in the minefield.

15. A method for minefield simulation as claimed in claim 14, wherein there is further included the step of initializing the minefield bit map according to an entered mine dispersion.

16. A method for minefield simulation as claimed in claim 13, wherein the step of determining by central computer a position of a player includes the step of transmitting the determined position of the player to a player detection device.

17. A method for minefield simulation as claimed in claim 16, wherein there is further included the step of determining whether the player is within the minefield boundaries.

18. A method for minefield simulation as claimed in claim 17, wherein there is further included the step of retrieving by the central computer the minefield bit map, if the player is within the minefield boundary.

19. A method for minefield simulation as claimed in claim 18, wherein there is further included the steps of:

assessing damages inflicted upon the players including dismounted troops and vehicles; and determining the damage to the dismounted troops and vehicles.

20. A method for minefield simulation as claimed in claim 19, wherein said step of determining by the central computer the effects of the expended mine includes the steps of:

disabling by the central computer the weapon and mobility of the player, if a catastrophic kill was determined; and triggering by the central computer audio and visual queues.

21. A method for minefield simulation as claimed in claim 19, wherein the step of determining by the central computer the effects of the expended mine includes the steps of:

disabling by the central computer the player's weapon, if a fire power kill has been determined; and triggering by the central computer audio and visual queues.

22. A method for minefield simulation as claimed in claim 19, wherein the step of determining by the central computer the effects of the expended mine includes the steps of:

disabling by the central computer the mobility of the player, if a mobility kill has been determined; and triggering by the central computer audio and visual queues.

23. A method for minefield simulation as claimed in claim 13, wherein there is further included the step of repeating the steps of determining by a player detection device a position of a player, determining by a central computer whether the player is within the activation radius of a mine, recording by the central computer and determining by the central computer the effects of the expended mine for each of a plurality of players including dismounted troops and vehicles.

24. A method for minefield simulation as claimed in claim 13, wherein said step of recording includes the steps of:

setting by the central computer to a first logic value locations in the minefield bit map corresponding to active mines;

setting by the central computer to a second logic value all locations in the minefield bit map except those locations with active mines; and updating by the central computer locations in the minefield bit map from the first logic value to the second logic value for expended mines.

* * * * *